US007860422B2

(12) United States Patent
Ogata et al.

(10) Patent No.: US 7,860,422 B2
(45) Date of Patent: Dec. 28, 2010

(54) IMAGE FORMING APPARATUS

(75) Inventors: Satoshi Ogata, Hachioji (JP); Jun Onishi, Hino (JP); Tadayuki Ueda, Kokubunji (JP)

(73) Assignee: Konica Minolta Business Technologies, Inc. (JP)

( * ) Notice: Subject to any disclaimer, the term of this patent is extended or adjusted under 35 U.S.C. 154(b) by 406 days.

(21) Appl. No.: 11/872,173

(22) Filed: Oct. 15, 2007

(65) Prior Publication Data

US 2008/0118273 A1 May 22, 2008

(30) Foreign Application Priority Data

Nov. 21, 2006 (JP) ..... 2006-314513
Nov. 21, 2006 (JP) ..... 2006-314514

(51) Int. Cl.
*G03G 21/14* (2006.01)

(52) U.S. Cl. ..... 399/76; 399/66; 399/167; 399/302

(58) Field of Classification Search ..... 399/38, 399/66, 75, 76, 159, 162, 167, 297, 299, 399/302, 303, 308
See application file for complete search history.

(56) References Cited

U.S. PATENT DOCUMENTS 5,897,241 A * 4/1999 Takano et al. ..... 399/162
5,995,802 A * 11/1999 Mori et al. ..... 399/394
2003/0081965 A1* 5/2003 Ueda et al. ..... 399/167
2006/0182455 A1* 8/2006 Matsushiro et al. ..... 399/49

FOREIGN PATENT DOCUMENTS

| | | |
|---|---|---|
| JP | 6-175427 | 6/1994 |
| JP | 8-220966 | 8/1996 |
| JP | 9-182488 | 7/1997 |

* cited by examiner

*Primary Examiner*—David P Porta
*Assistant Examiner*—Benjamin Schmitt
(74) *Attorney, Agent, or Firm*—Cantor Colburn LLP

(57) ABSTRACT

An image forming apparatus having a rotation body which is used for transferring an image, a drive section which rotates the rotation body, and a control section which sends a control signal to the drive section to control a speed of the rotation body, the image forming apparatus including: a test signal generating section which generates a test signal and adds it to the control signal; an angular velocity detecting section which detects an angular velocity of the rotation body; and a transfer function calculating section which obtains a latest transfer function of a rotation system including the rotation body and drive section, based on the angular velocity detected by the angular velocity detecting section and the test signal generated by the test signal generating section, wherein the control section controls the drive section, based on the latest transfer function obtained by the transfer function calculating section.

15 Claims, 7 Drawing Sheets

IMAGE FORMING APPARATUS

CROSS REFERENCE TO RELATED APPLICATION

This application is based on Japanese Patent Application No. 2006-314513 and No. 2006-314514 respectively filed on Nov. 21, 2006 and Nov. 21, 2006 with Japanese Patent Office, the entire content of which is hereby incorporated by reference.

BACKGROUND OF THE INVENTION

1. Field of the Technology

The present invention relates to an image forming apparatus for controlling the speed of a rotation body for rotating an image carrier for performing transfer, thereby adjusting image formation, and more particularly to an image forming apparatus for measuring a transfer characteristic, thereby controlling the speed of the rotation body.

2. Description of Related Art

The image forming apparatus has a rotation body for rotating a photosensitive drum for transferring an image and an intermediate transfer belt. And, to execute precisely image formation, it is necessary to adjust accurately the rotation speed of the rotation body. To adjust accurately the rotation speed in a system requiring highly precise control for driving such a rotation body, it is desirable to confirm the transfer characteristic of the drive system and then decide a control parameter.

Further, even if it is intended to rotate independently the photosensitive drum and intermediate transfer belt, force via the intermediate transfer belt acts on the photosensitive drum and the force may affect the rotation speed of each rotation body.

Conventionally, in the image forming apparatus, the transfer characteristic is measured beforehand using a prototype and the fixed control parameter decided on the basis of the results is used. Particularly, in a control system including repeat control used when executing the control more high-precisely, since the control using an inverse characteristic (here, "inverse characteristic" means an inverse function of the function expressing the transfer characteristic) of the transfer characteristic of the drive system is utilized, when the dissociation between the control parameter and the real transfer characteristic of the apparatus is large, the controllability is lowered. Therefore, generally, within a predictable change range of the transfer characteristic of the drive system, a control parameter is set so as to make the control stability and controllability compatible with each other. However, in actual, it is difficult to expect beforehand the change range of the transfer characteristic including a change with time and variations in the components, and to widen the stable range of control results in to widen the range for permitting speed change of the rotation body and to lower the accuracy of controllability. Therefore, it is very difficult to ensure a highly precise and wide stable range of control. Therefore, an art (for example, refer to Unexamined Japanese Patent Application Publication No. H6-175427) for obtaining a transfer function of rotation control, obtain a phase margin and a gain margin from the transfer function, and when the obtained values are larger than the values indicating the stable ranges, changing the control parameter, an art (for example, refer to Unexamined Japanese Patent Application Publication No. H8-220966), even if one of the rotation members is exchanged, for newly obtaining a transfer function of the system by the speed detecting section and resetting the control parameter, and an art (for example, refer to Unexamined Japanese Patent Application Publication No. H9-182488) for storing a speed variation during one rotation of the rotation body in the steady state, deciding a dominant frequency component from the data, obtaining a frequency response of the drive transfer system, calculating a response characteristic, and executing the repeat control on the basis of the response characteristic are proposed. In these control arts, the parameter is not set beforehand using a testing machine, but the transfer characteristic is measured using a real signal in a real machine and the control parameter is changed.

Under the control aforementioned, it is possible to calculate and change the control parameter using the real signal. However, under the control aforementioned, from the control instruction value sent to the control system by the real processing and the real angular velocity detection results at that time, the transfer characteristic is obtained. In this respect, to control the rotation body, since the rotation speed of the rotation body is slow, an input value at a low frequency close to 2 or 3 Hz acts most effectively. However, when using the input value used in a real control instruction for calculation of the parameter, the low frequency component, which has a poor SN ratio, can be used hardly, thus the control parameter is calculated using the transfer characteristic for an input value at a high frequency component. Therefore, the transfer characteristic which can actually be detected is restricted, and it is difficult to obtain the necessary characteristic, and the accuracy of the control by the control parameter calculated is lowered. Furthermore, the conventional control method controls independently the intermediate transfer belt and photosensitive drum, thus it is difficult to execute control in consideration of the force affecting the rotation speed of the photosensitive drum via the intermediate transfer belt.

The present invention was developed with the foregoing in view and is intended to provide an image forming apparatus for using a test signal including from a low frequency to a high frequency, detecting a transfer characteristic based on a signal transferred to the photosensitive drum via the intermediate transfer belt, calculating a parameter for changing an inverse filter from the transfer characteristic, controlling the rotation system by the changed inverse filter, and providing an image forming apparatus which reduces the mutual effect of the rotation bodies.

SUMMARY

The image forming apparatus reflecting one aspect of the present invention for accomplishing the above object has a rotation body which is used for transferring an image, a drive section which rotates the rotation body, and a control section which sends a control signal to the drive section to control a speed of the rotation body, the image forming apparatus including: a test signal generating section which generates a test signal and adds the test signal to the control signal; an angular velocity detecting section which detects an angular velocity of rotation of the rotation body; and a transfer function calculating section which obtains a latest transfer function of a rotation system including the rotation body and drive section, based on the angular velocity of rotation detected by the angular velocity detecting section and the test signal generated by the test signal generating section, wherein the control section controls the drive section, based on the latest transfer function obtained by the transfer function calculating section.

The image forming apparatus reflecting another aspect of the present invention has a first rotation body which rotates an image carrier for transferring an image to a transfer sheet, a second rotation body for transferring an image to the image carrier, a first drive section which rotates the first rotation body, a second drive section which rotates the second rotation body, a first control section which sends a control signal to the first drive section and controls a speed of the first rotation body, and a second control section which sends a control signal to the second drive section and controls a speed of the second rotation body, the image forming apparatus including: a test signal generating section which generates a test signal and adds the test signal to the control signal of the first drive section; a second angular velocity detecting section which detects an angular velocity of rotation of the second rotation body; and a second transfer function calculating section which obtains a latest transfer function of a second rotation system including the second rotation body and the second drive section, based on the angular velocity of rotation detected by the second angular velocity detecting section and the test signal generated by the test signal generating section, wherein the second control section controls the second drive section, based on the latest transfer function obtained by the second transfer function calculating section.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

First Embodiment

Figure 1:
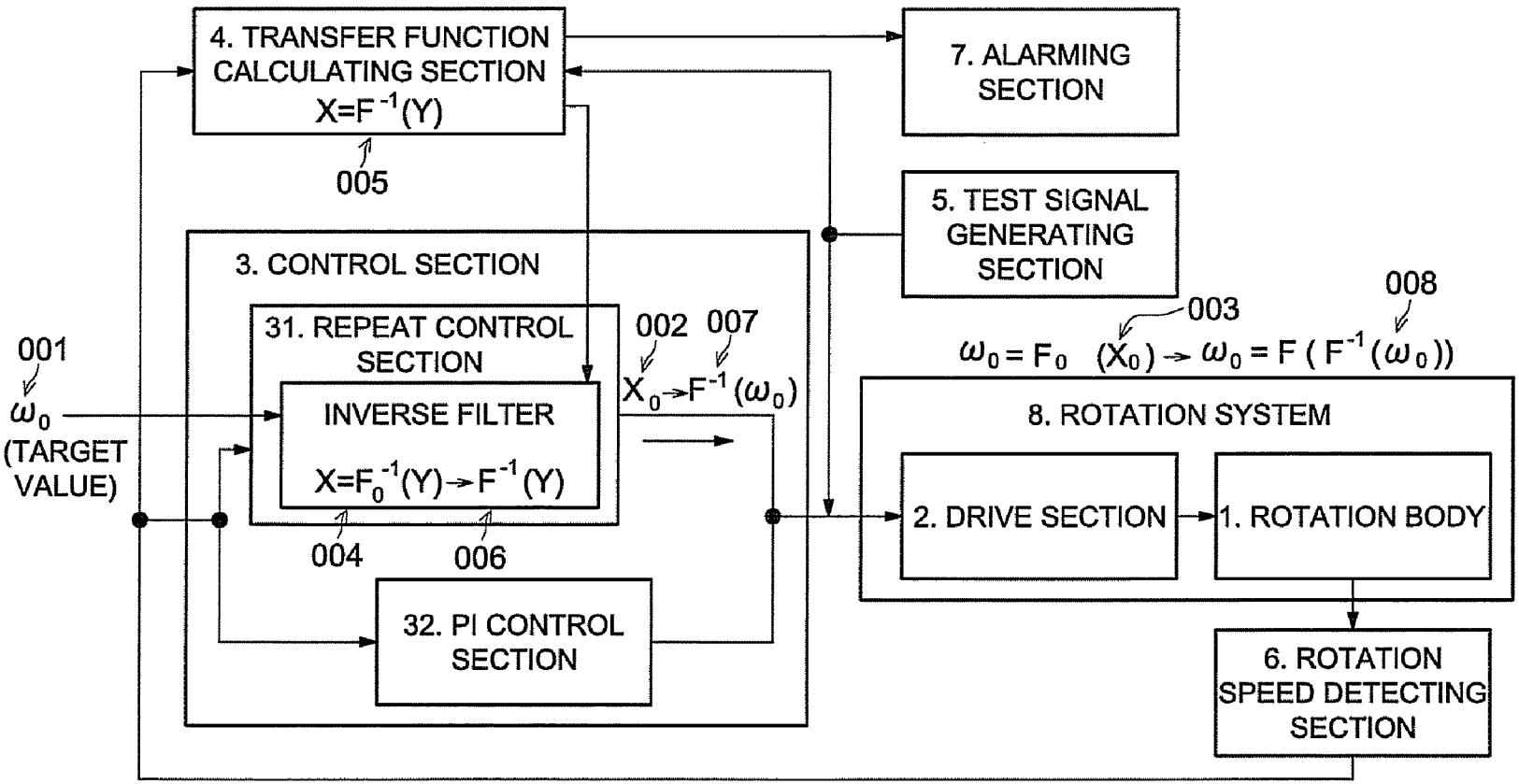
FIG. 1 is a block diagram of the image forming apparatus relating to the present invention.
Figure 2:
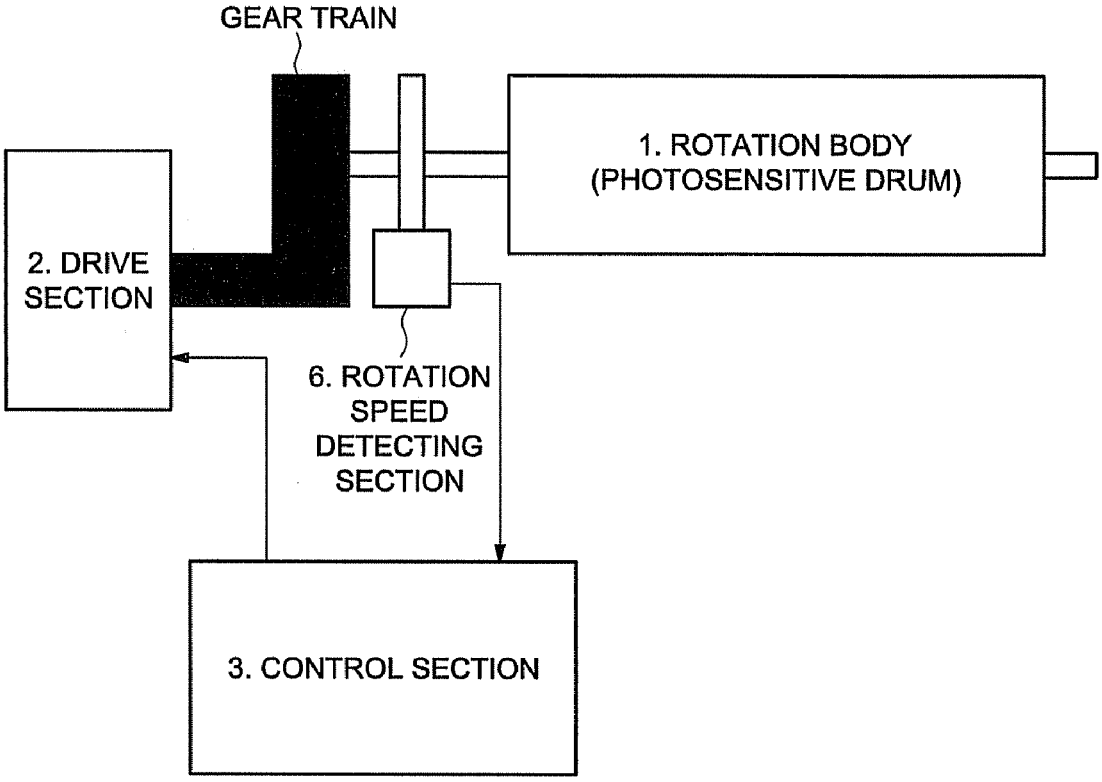
FIG. 2 is a schematic view of the drive controller of the image forming apparatus relating to the present invention.

Hereinafter, the image forming apparatus relating to the first embodiment will be explained. FIG. 1 is a block diagram showing the function of the image forming apparatus relating to the present invention. FIG. 2 is a schematic view of the drive controller of the image forming apparatus relating to the present invention. The image forming apparatus relating to the present invention, as shown in FIG. 1, includes a rotation body 1, a drive section 2, a control section 3, a transfer function calculating section 4, a test signal generating section 5, a rotation speed detecting section 6, and an alarming section 7. Furthermore, the control section 3 includes a repeat control section 31 and a PI control section 32. Here, the control section 3, transfer function calculating section 4, and rotation speed detecting section 6 are composed of a CPU. Further, as an example of the rotation body 1, a photoconductive drum or an intermediate transfer belt may be cited. Hereinafter, the rotation body 1 will be explained as a photosensitive drum.

The control section 3 lets the target angular velocity of rotation of the rotation body 1 pass through an inverse filter by the repeat control section 31 and calculates a control instruction signal for obtaining the target angular velocity of rotation. For example, assuming the target value as $\omega_0$ and the function for expressing the inverse filter as $F^{-1}(x)$, the control instruction signal is expressed as $F^{-1}(\omega_0)$. Here, the inverse filter is a filter for expressing the inverse characteristic of the transfer characteristic of a rotation system 8. The repeat control section 31 controls the rotation body 1 in accordance with the cycle thereof (for example, once per each rotation), thereby can reduce the periodic variation among the variations of the angular velocity of rotation of the rotation body 1.

The repeat control section 31 holds sampling data of the value of angular velocity of rotation for one rotation before one rotation. And, the repeat control section 31 subtracts a target value $\omega_0$ from the angular velocity of rotation (assumed as $\omega_0+\Delta\omega$, where $\Delta\omega$ indicates a variation) before one rotation, that is, calculates $(\omega_0+\Delta\omega)-\omega_0$ and then calculates the variation $\Delta\omega$ which is a difference between the angular velocity of rotation before one rotation and the target angular velocity of rotation. And, the repeat control section 31 lets the variation $\Delta\omega$ pass through the inverse filter and obtains a control instruction signal $F^{-1}(\Delta\omega)$ worth the variation. And, the repeat control section 31 subtracts the control instruction signal $F^{-1}(\Delta\omega)$ worth the variation from the control instruction signal $F^{-1}(\omega_0)$ before one rotation and calculates a control instruction signal $F^{-1}(\omega_0)-F^{-1}(\Delta\omega)$ in which the variation of the angular velocity of rotation before one rotation is incorporated. As a result, the repeat control section 31 controls so as to realize the angular velocity of rotation before one rotation $(\omega_0+\Delta\omega)$–the variation $\Delta\omega$=the target angular velocity of rotation $\omega_0$.

Furthermore, when changing the parameter (in detail, the parameter of the inverse function of the transfer function composing the inverse filter) and then changing the inverse filter (hereinafter, may be referred to as "calibration of the inverse filter"), the repeat control section 31, upon receipt of the parameters such as the torque constant of the inverse function of the latest transfer function obtained by the transfer function calculating section 4 and the coefficient of the item expressing the contact coefficient between the photosensitive drum and the intermediate transfer belt, changes the inverse filter held by the repeat control section 31. Here, the contact coefficient is a value for indicating that as the value thereof increases, the degree of adhesion between the photosensitive drum and the intermediate transfer belt increases. And, the repeat control section 31, after changing the inverse filter, calculates the control instruction signal aforementioned. Hereinafter, "parameter" indicates a parameter for changing the inverse filter.

Furthermore, the PI control section 32 executes the proportional control and integral control on the basis of the difference between the angular velocity of rotation fed back and the target angular velocity of rotation and calculates a control instruction signal for adjusting to the target angular velocity of rotation. And, the control section 3 transmits a control instruction signal obtained by adding the control instruction signal calculated by the PI control section 32 to the control instruction signal calculated by the repeat control section 31 to the drive section 2.

In this embodiment, to control more accurately the rotation system 8, in the control section 3, the repeat control section 31 and PI control section 32 are installed, though in principle, the control section 3 is operated only by the repeat control section 31, thus the PI control section 32 is not always necessary. The PI control section 32 is effective in suppression of a variation independent of the periodicity of the rotation body 1.

The drive section 2, upon receipt of the control instruction signal transmitted from the control section 3, generates rotation torque and rotates the rotation body 1. As shown in FIG. 2, really, the rotation torque generated by the drive section 2 is transferred to the rotation body 1 through the gear train.

From the rotation body 1 which is a photosensitive drum, a toner image is transferred to the rotating intermediate transfer belt and furthermore the image is transferred from the intermediate transfer belt to a transfer sheet.

Figure 3:
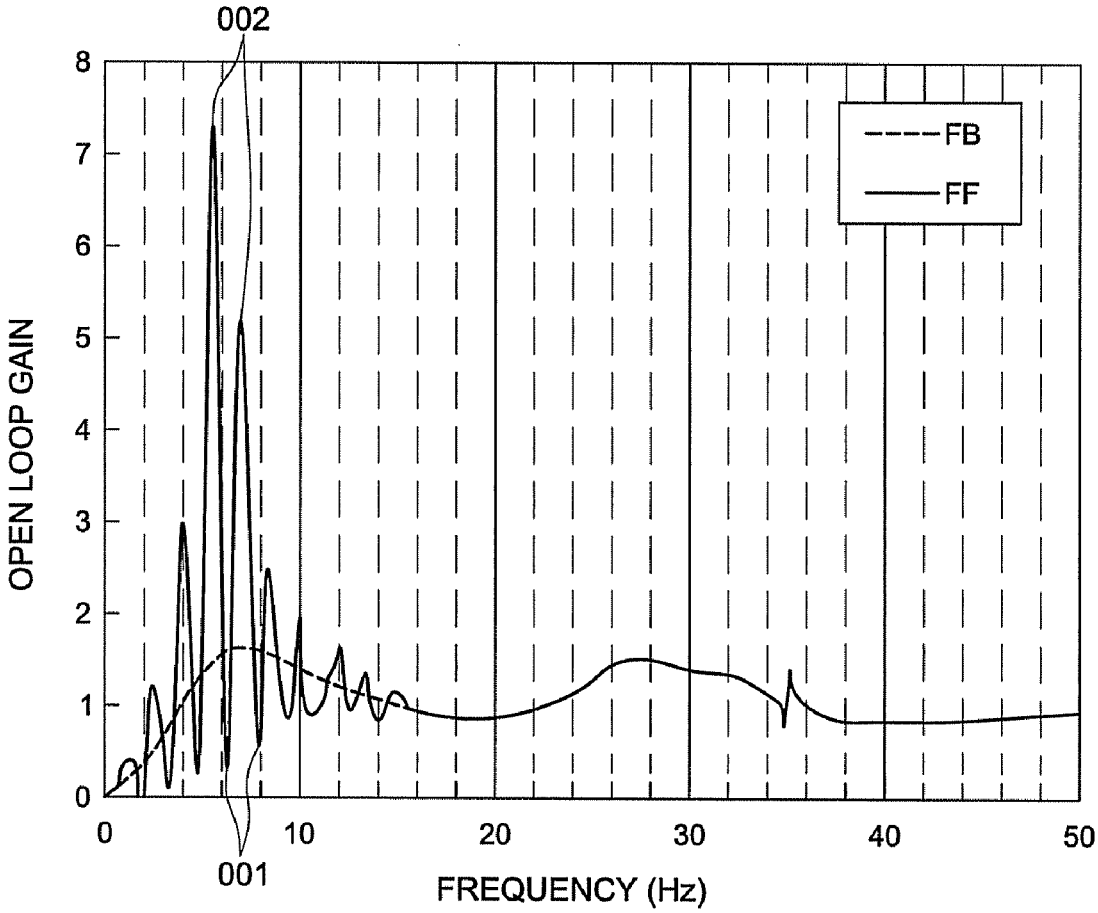
FIG. 3 is a drawing showing the control characteristic of the image controller relating to the present invention.

The test signal generating section 5 generates a test signal, puts the test signal on the control instruction signal sent from the control section 3 to the drive section 2, and then transmits the test signal to the transfer function calculating section 4. Here, for the test signal, a white noise including components from a low frequency to a high frequency is used. Here, the rotation body 1 rotates only 2 or 3 times per second, thus a signal in a low frequency band affects greatly the angular velocity of rotation of the rotation body 1, so that it is preferable to use a white noise including a low frequency band and particularly a white noise including a frequency band within the range of 5 to 10 times or less of the reference frequency (2 to 3 Hz in this embodiment) is preferable. Here, FIG. 3 which is a drawing showing the control characteristic of the rotation system 8 is referred to. In FIG. 3, the axis of abscissas indicates the frequency of the test signal inputted to the drive section 2 and the axis of ordinates indicates the transfer ratio corresponding to the frequency of the test signal. Here, the transfer ratio is a ratio of the angular velocity of rotation from the rotation speed detecting section 6 to the output value from the test signal generating section 5. Further, numeral FF shown in FIG. 3 indicates a curve of the control characteristic of the repeat control and FB indicates a curve of the control characteristic of the PI control. And, in FIG. 3, as the value of the axis of ordinates is made smaller, the control becomes more effective. For example, at a point 001, the control is very effective, though at a point 002, the control is not effective. It indicates that the point 001 effective in control is equivalent to an integer-fold cycle of one rotation of the rotation body 1 and at the point, the control is very effective, while inversely at a medium frequency thereof, the control is not effective. Further, in this case, it is found that at 16 Hz or less, the repeat control is effective. As mentioned above, as clearly shown in FIG. 3, in the low frequency band, the repeat control functions effectively.

The rotation speed detecting section 6 detects the angular velocity of rotation of the rotation body 1 and transmits the detected angular velocity of rotation to the transfer function calculating section 4 and control section 3. Here, as shown in FIG. 2, really, the rotation speed detecting section 6 is arranged on the shaft for transferring the rotation torque of the gear train to the rotation body 1 and detects the angular velocity of rotation of the shaft.

Here, changes in the angular velocity of rotation are not affected by the fixed portion such as the gear train but are almost caused by changes in the torque of the drive section 2 and the contact coefficient between the rotation body 1 and the intermediate transfer belt. The change in the torque is caused when much toner is put on the rotation body 1, thus the rotation body becomes heavier. Further, additionally, also when the gears are changed, the angular velocity of rotation is changed.

The transfer function calculating section 4 removes the angular velocity of rotation given by the control instruction signal from the control section 3 from the angular velocity of rotation received from the rotation speed detecting section 6 and analyzes and obtains the angular velocity of rotation for the output value from the test signal generating section 5 for each frequency. Removing the angular velocity of rotation may be, for example, sending the control instruction signal to the drive section 2 without adding the test signal, measuring the angular velocity of rotation at that time, and subtracting it from the angular velocity of rotation by the control instruction signal with the test signal added. The transfer function calculating section 4 repeats obtaining of the output value from the test signal generating section 5 and the transfer ratio of the rotation system 8 5000 times and stores the respective output values obtained from the test signal generating section 5 and the transfer ratios of the rotation system 8 corresponding to them in a memory section (not drawn) in the transfer function calculating section 4. Next, the output values from the test signal generating section 5 are indicated on the axis of abscissas, and the transfer ratios of the rotation system 8 are indicated on the axis of ordinates, and the stored 5000 points are plotted, thus a graph representing the transfer characteristic of the rotation system 8 is formed. Here, when the number of points to be plotted is large, the graph of the transfer characteristic can be formed more accurately, though inversely, the time required for making the graph is increased in proportion to the number of points to be plotted. Therefore, in this embodiment, as points necessary to form a graph accurate to a certain extent in a short time, 5000 points are plotted, though in consideration of the relationship between the time and the accuracy, other values may be adopted. Further, in this embodiment, the points on the graph of the output value and transfer ratio are plotted, thus a function is obtained, though the function calculating method, if a function for expressing the transfer characteristic can be obtained, is not restricted particularly.

Here, the transfer function calculating section 4 confirms the transfer ratio to the output value, for example, from the 3-Hz test signal generating section 5 and when the value is larger than the value two times of the transfer ratio when the signal is not deteriorated, permits the alarming section 7 to notify an alarm. For example, when the transfer ratio to 3 Hz when no deterioration is caused is 0.8, if the transfer ratio after deteriorated is 1.6 or higher, an alarm is notified. Here, in this embodiment, although 3 Hz greatly affecting the rotation speed of the rotation body 1 is adopted as a reference, if the reference frequency includes a low frequency greatly affecting the rotation speed, an output value from the another-frequency test signal generating section 5 may be defined as a reference. Further, in this embodiment, when the measured transfer ratio reaches two times of the transfer ratio when no deterioration occurs, it is controlled hardly, so that the threshold value is set at two times of the transfer ratio when no deterioration occurs, though the threshold value, if it is a value which is judged to be not effective in control, is not restricted particularly, and for example, another value can be adopted that the threshold value is defined as an absolute value such that the upper limit of the transfer ratio is set at 2 and the lower limit is set at 0.1.

The transfer function calculating section 4 calculates a function identified in a formed graph. The calculating method calculates a function obtained by setting a constitution model of the image output apparatus, expressing the dynamic characteristic including drum driving and belt motion by an equation of motion, and changing the parameters such as the torque constant of the motor varying greatly with the apparatus state and the contact coefficient between the drum and the belt so as to make the characteristic calculated from the equation of motion coincide with the arrangement of the points really plotted on the graph.

The transfer function calculating section 4 calculates an inverse function of the obtained function. A method for obtaining the inverse function is to prepare an inverse function for the equation of motion of the dynamic characteristic and replace the formula with a discrete formula in accordance with control sampling.

The transfer function calculating section 4 subtracts the values of parameters for calibrating the inverse filter from the obtained function. Here, in the drive system of the present invention, an article considered to affect variations in the angular velocity of rotation of the rotation body is the torque constant of the drive section, so that the parameters are the torque constant and the contact coefficient between the drum and the belt in the function. Furthermore, the transfer function calculating section 4 sends the values of the concerned parameters to the control section 3.

Here, the constitution of the inverse filter will be explained using the values. Assuming the target angular velocity of rotation of the rotation body 1 as $\omega_0$ (001 shown in FIG. 1), a control instruction signal of the inverse filter before calibration to obtain the angular velocity as $X_0$ (002 shown in FIG. 1), and the transfer function of the rotation system 8 before variation as $F_0(X)$, $\omega_0=F_0(X_0)$ (003 shown in FIG. 1) is held originally. In other words, assuming the inverse function of $Y=F_0(X)$ as $X=F_0^{-1}(Y)$ (004 shown in FIG. 1), $X_0=F_0^{-1}(\omega_0)$ is held. However, depending on adhesion of toner and the magnitude of the contact coefficient between the photosensitive drum and the intermediate transfer belt, the transfer characteristic of the rotation system 8 is changed. Therefore, the transfer function calculating section 4 calculates the changed transfer function from the output value from the test signal generating section 5 and the angular velocity of rotation detected by the rotation speed detecting section 6 and the transfer function is assumed as $Y=F(X)$. In the case of $Y=F(X)$, even if a control instruction signal $X_0$ is inputted, the target angular velocity of rotation of the rotation body 1 cannot be obtained. Therefore, the transfer function calculating section 4 obtains an inverse function $X=F^{-1}(Y)$ (005 shown in FIG. 1) of the obtained transfer function. The transfer function calculating section 4 sends the parameters of the torque constant of $F^{-1}(Y)$ and the contact coefficient between the drum and the belt to the repeat control section 31 and the repeat control section 31 changes the function of the inverse filter to $F^{-1}(Y)$ (006 shown in FIG. 1). Here, the repeat control section 31, upon receipt of the target value $\omega_0$ of the angular velocity of rotation of the rotation body 1, obtains a control instruction signal $F^{-1}(\omega_0)$ (007 shown in FIG. 1). The control instruction signal $F^{-1}(\omega_0)$ is $\omega_0=F(F^{-1}(\omega_0))$ (008 shown in FIG. 1), so that it is a control instruction signal that when passing the current transfer function $F(X)$ of the rotation system 8, it becomes $\omega_0$. As mentioned above, the repeat control section 31 obtains a control instruction signal for obtaining the target value of the angular velocity of rotation of the rotation body 1 after the transfer characteristic is changed and sends the control instruction signal to the drive section 2.

In other words, it may be said that the transfer function calculating section 4 measures that the transfer function of the rotation system 8 is changed from $F_0(X)$ to $F(X)$ and calibrates the inverse filter of the repeat control section 31 using the inverse function $F^{-1}(Y)$ thereof.

The aforementioned calibration of the inverse filter due to parameter change, in this embodiment, is executed by performing the calibration operation at the time decided by an operator such as once a day or once a month and the calibration for the calibrated inverse filter is structured so as to be kept in the present state until the next calibration operation is performed. For example, the original image forming mode and calibration mode are installed in the image forming apparatus, and in the calibration mode, as explained above, the inverse filter of the repeat control section 31 is calibrated from $F_0^{-1}(Y)$ to $F^{-1}(Y)$, and after it is finished, the mode is switched to the image forming mode, and the connection for adding the test signal from the test signal generating section 5 to the control instruction signal and the connection from the transfer function calculating section 4 to the inverse filter 30 are cut off, thus the original image formation is performed. In the image forming mode, a constitution may be used that the transfer function calculating section 4, upon receipt of the output value from the test signal generating section 5 and the angular velocity of rotation from the rotation speed detecting section 6, when the output value is larger than the threshold value aforementioned, permits the alarming section 7 to notify an alarm. Such timing for performing the calibration mode is decided according to the degree of deterioration of the rotation system 8 for the time.

Further, when calibrating the inverse filter when the image forming apparatus is really forming an image, it is necessary to lower the level of the test signal as much as possible, thereby reduce the effect on image formation by the test signal inasmuch as is possible.

Figure 4:
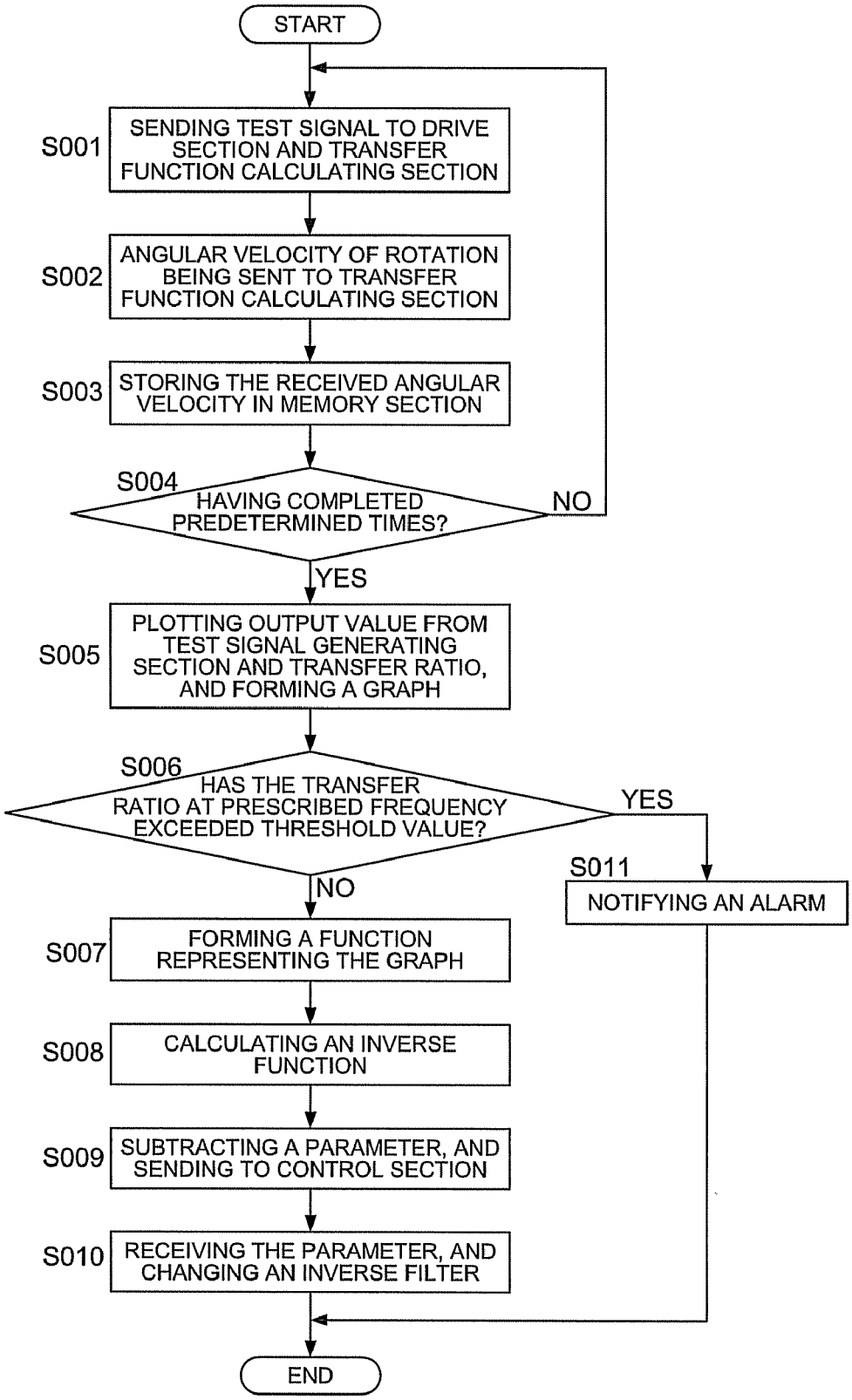
FIG. 4 is a drawing showing the flow of calibration of the inverse filter by the transfer function calculating section.

Next, by referring to FIG. 4, the flow of calibration of the inverse filter by the transfer function calculating section 4 will be explained. Here, FIG. 4 is a flow chart of calibration of the inverse filter by the transfer function calculating section 4.

Step S001: The test signal generating section 5 sends the test signal to the transfer function calculating section 4 and puts the test signal on the control instruction signal sent from the control section 3 to the drive section 2.

Step S002: The rotation speed detecting section 6 detects the angular velocity of rotation of the rotation body 1 and sends it to the transfer function calculating section 4.

Step S003: The transfer function calculating section 4 calculates the transfer ratio corresponding to the output value of the test signal generating section 5 on the basis of the received angular velocity of rotation and stores it in the memory section.

Step S004: The transfer function calculating section 4 judges whether the predetermined number of times (5000 times) is completed or not. When it is not completed, the transfer function calculating section 4 repeats Steps S001 to S003 and when it is completed, goes to Step S005.

Step S005: The transfer function calculating section 4 plots the stored 5000 output values of the test signal generating section 5 and the transfer ratios corresponding to the output values of the test signal generating section 5, thereby forms a graph.

Step S006: The transfer function calculating section 4 judges whether the transfer ratio at the prescribed frequency (3 Hz) exceeds the threshold value (1.6) or not. When it does not exceed the threshold value, the transfer function calculating section 4 goes to Step S007 and when it exceeds the threshold value, the transfer function calculating section 4 goes to Step S011.

Step S007: The transfer function calculating section 4 forms a function ($Y=F(X)$) representing the transfer characteristic.

Step S008: The transfer function calculating section 4 forms an inverse function ($X=F^{-1}(Y)$) of the function $Y=F(X)$.

Step S009: The transfer function calculating section 4 subtracts the parameter value from the inverse function $X=F^{-1}(Y)$ and sends the concerned parameter value to the control section 3.

Step S010: The control section 3 receives the parameter value from the transfer function calculating section 4 and calibrates the inverse filter held by the repeat control section 31.

Step S011: The transfer function calculating section 4 permits the alarming section 7 to notify an alarm and finishes the calibration of the inverse filter.

Second Embodiment

The second embodiment of the present invention will be explained. The second embodiment of the present invention, as a test signal, instead of a white noise including from a low frequency band to a high frequency band, uses a test signal in a low frequency band and calibrates the inverse filter.

In this respect, when many noises are added to the control instruction signal, a fear of an occurrence of a displacement of an image to be formed is increased. Therefore, when the frequency band of the test signal is narrowed as much as possible, the effect on image formation is reduced. Furthermore, the frequency band affecting most the angular velocity of rotation of the rotation body 1 is a frequency band having a cycle close to the time required for one rotation of the rotation body 1 and since the rotation body 1 rotates two or three times for one second, it is desirable to use a test signal in a low frequency band, particularly a test signal in a frequency band of 2 or 3 Hz. As mentioned above, only by a signal in a frequency band for affecting most the angular velocity of rotation of the rotation body 1, the effect on the angular velocity of rotation of the rotation body 1 is great and the effect by a signal in another frequency band is negligibly small compared with it, so that the control instruction signal can be controlled.

Here, the operation of the image forming apparatus in this embodiment will be explained. Upon receipt of a signal obtained by adding a signal in a low frequency band from the test signal generating section 5 to the control instruction signal outputted by the control section 3, the rotation body 1, drive section 2, and rotation speed detecting section 6 operate similarly to the first embodiment and the angular velocity of rotation is sent to the transfer function calculating section 4. Further, the output value having a low frequency component from the test signal generating section 5 is sent to the transfer function calculating section 4.

The transfer function calculating section 4, upon receipt of the angular velocity of rotation and the output value from the test signal generating section 5, similarly to the first embodiment, obtains the transfer ratio corresponding to the output value having a low frequency component from the test signal generating section 5. The transfer function calculating section 4, similarly to the first embodiment, stores the respective output values obtained from the test signal generating section 5 and the transfer ratios corresponding to them in a memory section (not drawn) installed in the transfer function calculating section 4, puts the output values from the test signal generating section 5 on the axis of abscissas, puts the transfer ratios on the axis of ordinates, plots the stored points, forms a graph representing the transfer characteristic of the rotation system 8, obtains the transfer function which is a function identified in the graph, calculates an inverse function of the transfer function, thereby calculates parameter values for calibrating the inverse filter, and sends the parameter values to the control section 3.

The control section 3, similarly to the first embodiment, calibrates the inverse filter using the received parameter values, calculates a control instruction signal corresponding to the target rotation speed of the rotation body 1, and sends the control instruction signal to the drive section 2.

As mentioned above, the control section 3 controls the rotation body 1 using a signal having a low frequency component affecting greatly the rotation speed of the rotation body 1 as a test signal, thereby by lightening the load due to operations by the transfer function calculating section 4, can control accurately the rotation body 1.

Third Embodiment

Figure 5:
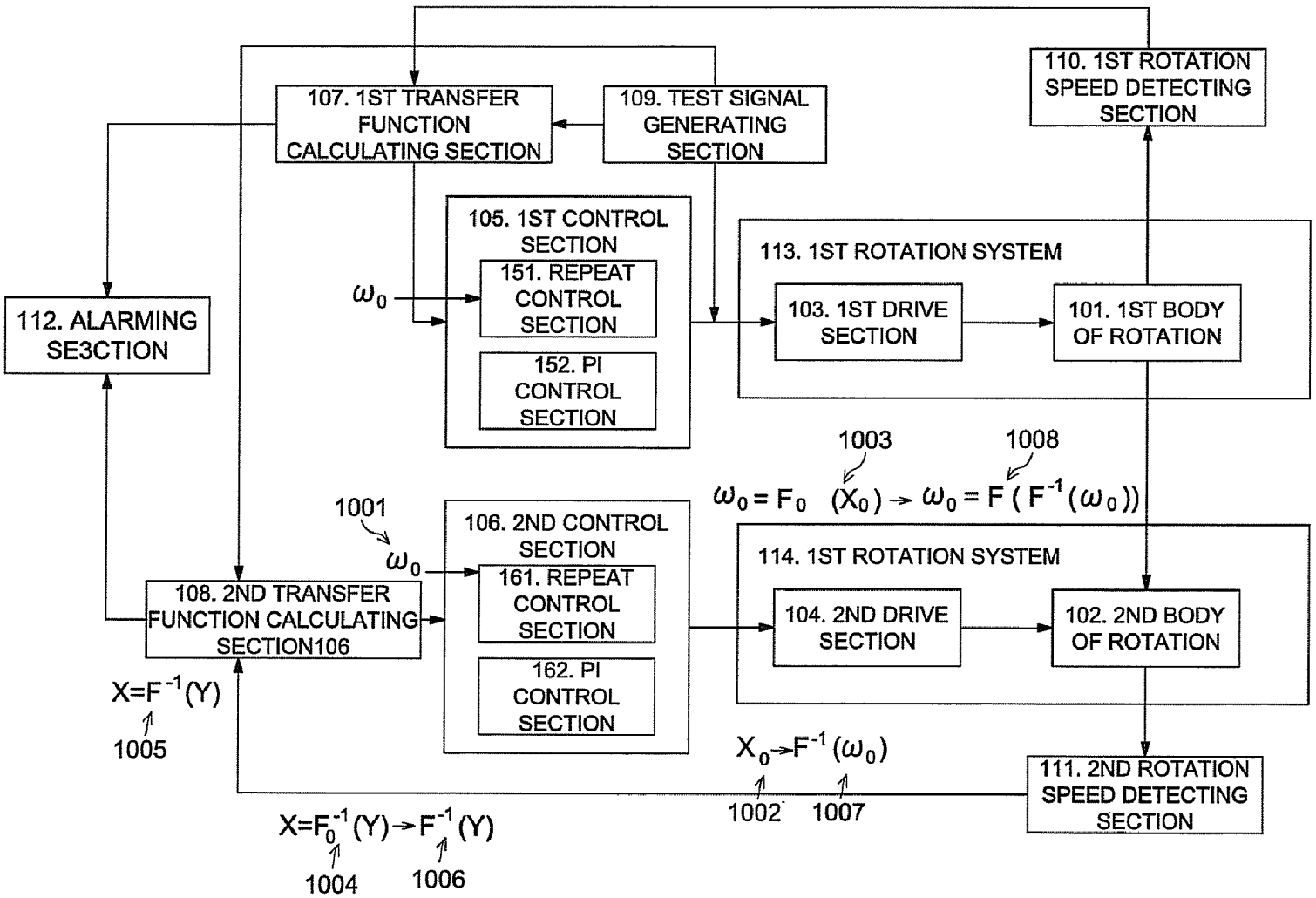
FIG. 5 is a block diagram of the image forming apparatus relating to the present invention.
Figure 6:
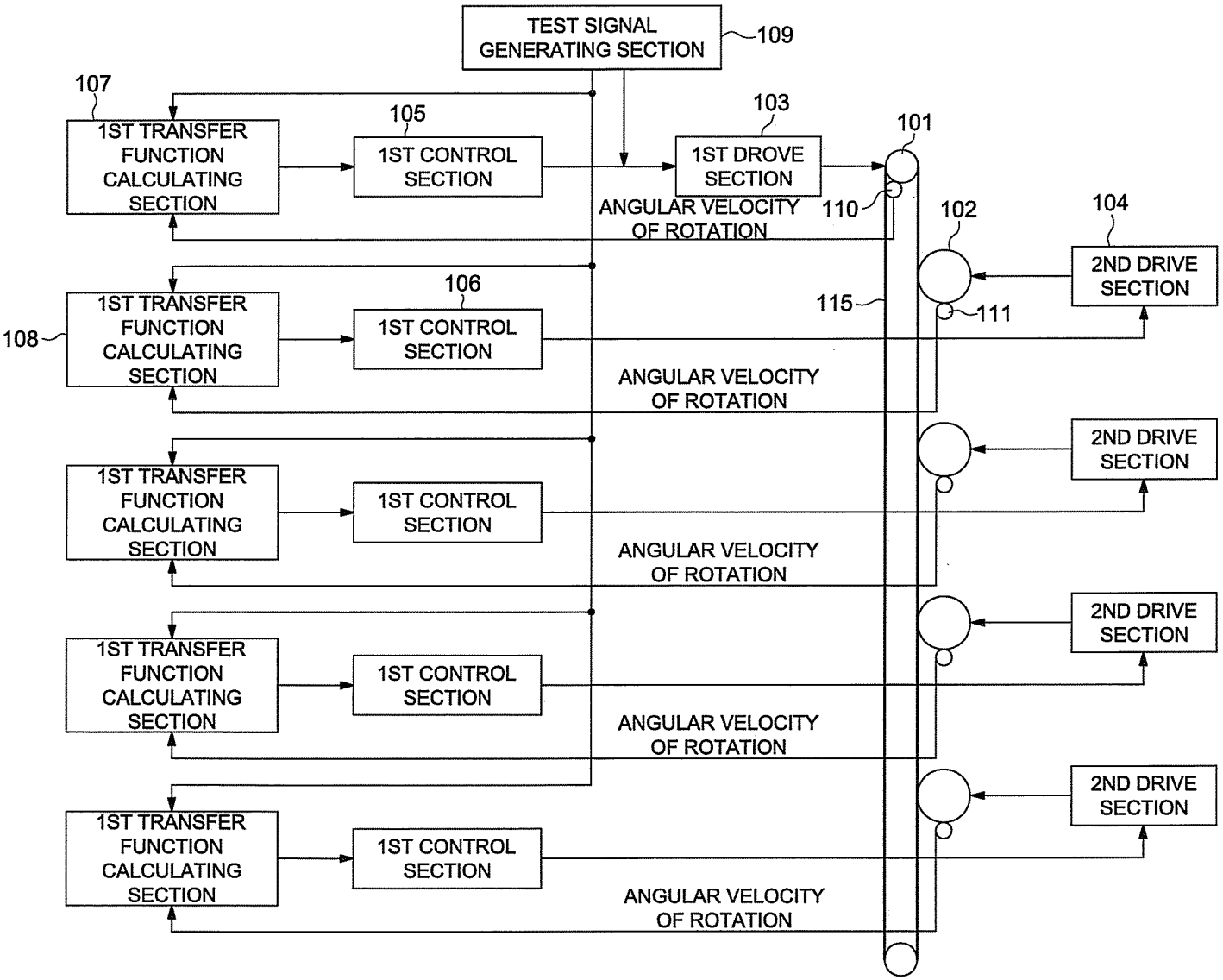
FIG. 6 is a schematic view of the constitution of the image forming apparatus relating to the present invention.
Figure 7:
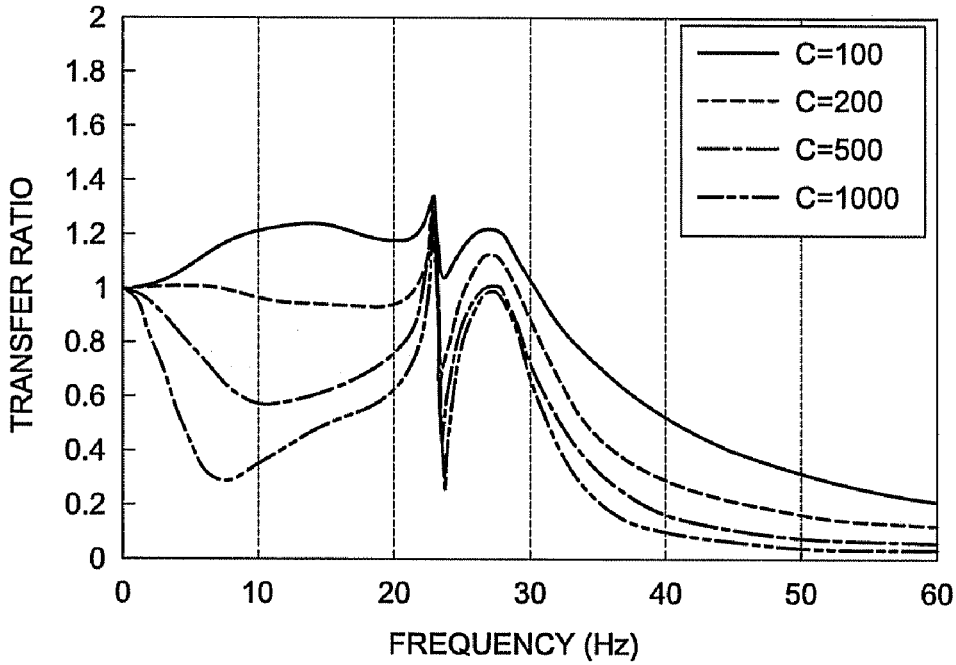
FIG. 7 is a drawing showing the change of the transfer function of the first rotation system when the contact coefficient is changed.
Figure 8:
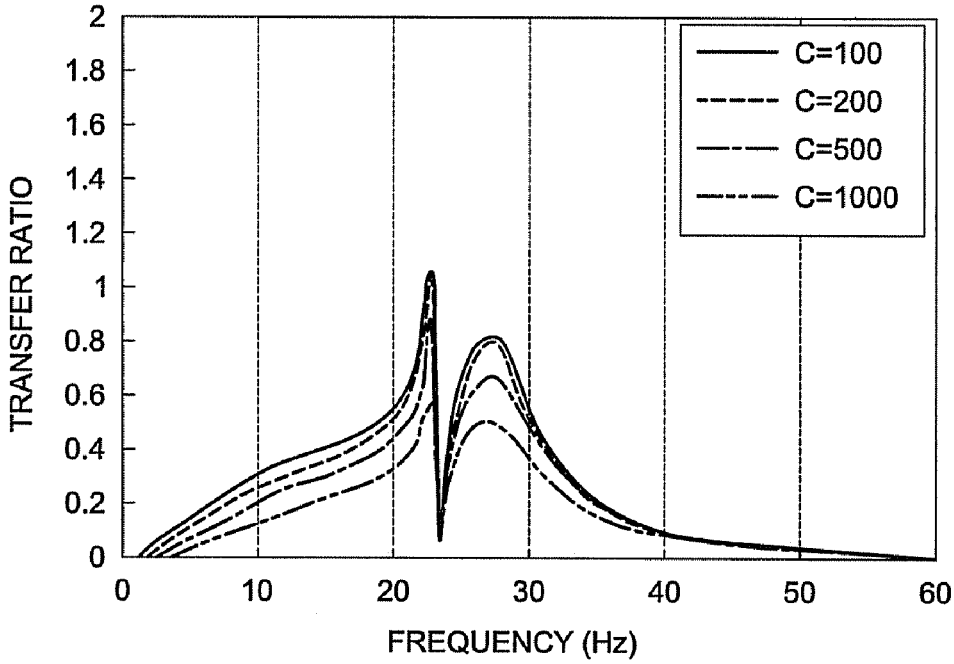
FIG. 8 is a drawing showing the change of the transfer function of the second rotation system when the contact coefficient is changed.

Hereinafter, the image forming apparatus relating to the third embodiment will be explained. FIG. 5 is a block diagram showing the function of the image forming apparatus relating to the present invention. FIG. 6 is a schematic view of the constitution of the image forming apparatus relating to the present invention. FIG. 3 is a drawing showing the control characteristic of the image controller relating to the present invention. FIG. 7 is a drawing showing the change of the transfer function of the first rotation system when the contact coefficient is changed and FIG. 8 is a drawing showing the change of the transfer function of the second rotation system when the contact coefficient is changed. Here, the contact coefficient is a value for indicating that as the value thereof increases, the degree of adhesion between the intermediate transfer belt and each rotation body increases.

The image forming apparatus relating to this embodiment, as shown in FIG. 5, includes a first rotation body 101, a second rotation body 102, a first drive section 103, a second drive section 104, a first control section 105, a second control section 106, a first transfer function calculating section 107, a second transfer function calculating section 108, a test signal generating section 109, a first rotation speed detecting section 110, a second rotation speed detecting section 111, and an alarming section 112. Here, the first rotation body 101 and first drive section 103 compose the first rotation system 113 and the second rotation body 102 and second drive section 104 compose the second rotation system 114. Furthermore, the first control section 105 includes a repeat control section 151 and a PI control section 152 and the second control section 106 includes a repeat control section 161 and a PI control section 162. Here, the first control section 105, second control section 106, first transfer function calculating section 107, second transfer function calculating section 108, first rotation speed detecting section 110, and second rotation speed detecting section 111 are composed of a CPU. Further, as shown in FIG. 6, as an example of the first rotation body 101, there is a rotation body for rotating the intermediate transfer belt 115 and as an example of the second rotation body 102, there is a photosensitive drum for transferring a toner image to the intermediate transfer belt 115. And, as shown in FIG. 6, the first rotation body 101 rotates, and the intermediate transfer belt 115 is rotated, and a toner image on the second rotation body 102 is transferred onto the rotating intermediate transfer belt 115. This embodiment provides a color image forming apparatus of a tandem system, so that four second rotation bodies 102 which are photosensitive drums of four colors of cyan, magenta, yellow, and black are installed. In FIG. 6, there are four rotation systems 114 composed of a set of the second rotation body 102 and second drive section 104, and there are four transfer function calculating sections 108 and second control sections 106 corresponding to them, though in FIG. 6, only one representative thereof is coded, and coding of the other three sections is omitted, though the other three sections can be expressed by the same code.

The first control section 105 lets the target angular velocity of rotation of the first rotation body 101 pass through the inverse filter by the repeat control section 151 and calculates an input value for obtaining the target angular velocity of rotation. For example, assuming the target value as $\omega_0$ and the function for expressing the inverse filter as $F^{-1}(x)$, the input value is expressed as $F^{-1}(\omega_0)$. Here, the inverse filter is a filter for expressing the transfer characteristic of the first rotation system 113. The repeat control section 151 controls the first rotation body 101 in accordance with the cycle thereof (for example, once per each rotation), thereby can reduce the periodic variation among the variations of the angular velocity of rotation of the first rotation body 101.

The repeat control section 151 holds sampling data of the value of angular velocity of rotation for one rotation before one rotation. And, the repeat control section 151 subtracts a target value $\omega_0$ from the angular velocity of rotation (assumed as $\omega_0+\Delta\omega$, where $\Delta\omega$ indicates a variation) before one rotation, that is, calculates $(\omega_0+\Delta\omega)-\omega_0$ and then calculates the variation $\Delta\omega$ which is a difference between the angular velocity of rotation before one rotation and the target angular velocity of rotation. And, the repeat control section 151 lets the variation $\Delta\omega$ pass through the inverse filter and obtains a control instruction signal $F^{-1}(\Delta\omega)$ worth the variation. And, the repeat control section 31 subtracts the control instruction signal $F^{-1}(\Delta\omega)$ worth the variation from the control instruction signal $F^{-1}(\omega_0)$ before one rotation and calculates a control instruction signal $F^{-1}(\omega_0)-F^{-1}(\Delta\omega)$ in which the variation of the angular velocity of rotation before one rotation is incorporated. As a result, the repeat control section 151 controls so as to realize the angular velocity of rotation before one rotation $(\omega_0+\Delta\omega)$−the variation $\Delta\omega$=the target angular velocity of rotation $\omega_0$.

Furthermore, when changing the parameter (in detail, the parameter of the inverse function of the transfer function composing the inverse filter) and then changing the inverse filter (hereinafter, may be referred to as "calibration of the inverse filter"), the first control section 105, upon receipt of the parameters such as the torque constant of the inverse function of the latest transfer function obtained by the first transfer function calculating section 107 and the contact coefficient between the second rotation body 102 and the intermediate transfer belt 115, changes the inverse filter held by the repeat control section 151. And, the repeat control section 151, after changing the inverse filter, calculates the control instruction signal aforementioned. Hereinafter, just "parameter" indicates a parameter for changing the inverse filter.

Furthermore, the PI control section 152 executes the proportional control and integral control on the basis of the difference between the angular velocity of rotation fed back and the target angular velocity of rotation and calculates a control instruction signal for adjusting to the target angular velocity of rotation. And, the first control section 105 transmits a control instruction signal obtained by adding the control instruction signal calculated by the PI control section 152 to the control instruction signal calculated by the repeat control section 151 to the first drive section 103.

Further, the second control section 106, similarly to the first control section 105, also lets the target angular velocity of rotation of the second rotation body 2 pass through the inverse filter by the repeat control section 161 and calculates an input value for obtaining the target angular velocity of rotation. The repeat control section 161, similarly to the repeat control section 151, also controls the second rotation body 102 in accordance with the cycle thereof (for example, once per each rotation), thereby reduces the periodic variation among the variations of the angular velocity of rotation of the second rotation body 102.

The repeat control section 161, similarly to the repeat control section 151, holds sampling data of the value of angular velocity of rotation for one rotation before one rotation and calculates a control instruction signal incorporated with the difference in the angular velocity of rotation before one rotation.

Furthermore, when changing the parameter and then changing the inverse filter, the second control section 106, similarly to the first control section 105, upon receipt of the parameters such as the torque constant of the inverse function of the latest transfer function obtained by the second transfer function calculating section 108 and the contact coefficient between the second rotation body 102 and the intermediate transfer belt 115, changes the inverse filter held by the repeat control section 161. And, the repeat control section 161, after changing the inverse filter, calculates the control instruction signal aforementioned.

Furthermore, the PI control section 162, similarly to the PI control section 152, executes the proportional control and integral control on the basis of the difference between the angular velocity of rotation fed back and the target angular velocity of rotation and calculates a control instruction signal for adjusting to the target angular velocity of rotation. And, the second control section 106 transmits a control instruction signal obtained by adding the control instruction signal calculated by the PI control section 162 to the control instruction signal calculated by the repeat control section 161 to the second drive section 104.

In this embodiment, to control more accurately the first rotation system 113 and second rotation system 114, the repeat control section 151 and PI control section 152 are installed in the first control section 105 and the repeat control section 161 and PI control section 162 are installed in the second control section 106, though in principle, the operation is performed even only by the repeat control section 151 and repeat control section 161, so that the PI control section 152 and PI control section 162 are not necessary always. The PI control section 152 and PI control section 162 are effective in suppression of variations independent of the periodicity of the first rotation body 101 and second rotation body 102.

The first drive section 103 generates rotation torque upon receipt of the control instruction signal transmitted from the first control section 105 and rotates the first rotation body 101. And, the first rotation body 101 rotates, thus the intermediate transfer belt 115 rotates. Further, the second drive section 104 generates rotation torque upon receipt of the control instruction signal transmitted from the second control section 106 and rotates the second rotation body 102. And, a toner image is transferred from the second rotation body 102 to the rotating intermediate transfer belt 115 and thereafter, the image is transferred from the intermediate transfer belt 115 to a transfer sheet.

The test signal generating section 109 generates a test signal, puts the test signal on the control instruction signal sent from the first control section 105 to the first drive section 103, and then transmits the test signal to the first transfer function calculating section 107 and second transfer function calculating section 108. Here, for the test signal, a white noise including components from a low frequency to a high frequency is used. Here, the first rotation body 101 and second rotation body 102 rotate only 2 or 3 times per second, thus a signal in a low frequency band affects greatly the angular velocities of rotation of the first rotation body 101 and second rotation body 102, so that it is preferable to use a white noise including a low frequency band and particularly a white noise including a frequency band within the range of 5 to 10 times or less of the reference frequency (2 to 3 Hz in this embodiment) is preferable.

Here, FIG. 3 which is a drawing showing the control characteristic of the first rotation system 113 is referred to. In FIG. 3, the axis of abscissas indicates the frequency of the test signal inputted to the first drive section 103 and the axis of ordinates indicates the transfer ratio corresponding to the frequency of the test signal. Here, the transfer ratio is a ratio of the angular velocity of rotation from the first rotation speed detecting section 110 to the output value from the test signal generating section 109. Further, numeral FF shown in FIG. 3 indicates a curve of the control characteristic of the repeat control and FB indicates a curve of the control characteristic of the PI control. And, in FIG. 3, as the value of the axis of ordinates is made smaller, the control becomes more effective. For example, at a point 001, the control is very effective, though at a point 002, the control is not effective. It indicates that the point 001 effective in control is equivalent to an integer-fold cycle of one rotation of the first rotation body 101 and at the point, the control is very effective, while inversely at a medium frequency thereof, the control is not effective. Further, in this case, it is found that at 16 Hz or less, the repeat control is effective. As mentioned above, as clearly shown in FIG. 3, in the low frequency band, the repeat control functions effectively. The same may be said with the control characteristic of the second rotation system 114.

The first rotation speed detecting section 110 and second rotation speed detecting section 111 detect respectively the angular velocity of rotation of the first rotation body 101 and the angular velocity of rotation of the second rotation body 102 and transmit the detected angular velocities of rotation to the first transfer function calculating section 107 and first control section 105 and the second transfer function calculating section 108 and second control section 106.

Here, changes in the angular velocity of rotation are not affected by the fixed portion of the gear train but are almost caused by changes in the torque of the first drive section 103 or the second drive section 104 and the contact coefficient between the second rotation body 102 and intermediate transfer belt 115. The change in the torque is caused when much toner is put on the first rotation body 101 or the second rotation body 102, thus the rotation bodies become heavier. Further, additionally, also when the gears are changed, the angular velocity of rotation is changed.

The first transfer function calculating section 107 removes the angular velocity of rotation given by the control instruction signal from the first control section 105 from the angular velocity of rotation received from the first rotation speed detecting section 110 and analyzes and obtains the angular velocity of rotation for the output value from the test signal generating section 109 for each frequency. Removing the angular velocity of rotation may be, for example, sending the control instruction signal to the first drive section 103 without adding the test signal, measuring the angular velocity of rotation of the first rotation body 101 at that time, and subtracting it from the angular velocity of rotation of the first rotation body 101 by the control instruction signal with the test signal added.

Further, the second transfer function calculating section 108 removes the angular velocity of rotation given by the control instruction signal from the first control section 105 from the angular velocity of rotation received from the second rotation speed detecting section 111 and analyzes and obtains the angular velocity of rotation for the output value from the test signal generating section 109 for each frequency.

Next, the first transfer function calculating section 107 and second transfer function calculating section 108 repeat obtaining of the output value from the test signal generating section 109 and the respective transfer ratios of the first rotation system 113 and second rotation system 114 5000 times and store the output values obtained from the test signal generating section 109 and the transfer ratios of the first rotation system 113 and second rotation system 114 corresponding to them in memory sections (not drawn) installed therein. Next, the output values from the test signal generating section 109 are indicated on the axis of abscissas, and the respective transfer ratios of the first rotation system 113 and second rotation system 114 are indicated on the axis of ordinates, and the stored 5000 points are plotted, thus graphs representing the respective transfer characteristics of the first rotation system 113 and second rotation system 114 are formed. Here, when the number of points to be plotted is large, the graphs of the transfer characteristics can be formed more accurately, though inversely, the time required for making the graphs is increased in proportion to the number of points to be plotted. Therefore, in this embodiment, as points necessary to form a graph accurate to a certain extent in a short time, 5000 points are plotted, though in consideration of the relationship between the time and the accuracy, other values may be adopted. Here, when the contact coefficient between the intermediate transfer belt 115 and the second rotation body 102 is changed, a graph representing the relationship between the control instruction signal to the first drive section 103 and the transfer ratio of the first rotation system 113 using the axis of abscissas indicating the frequency of the control instruction signal and the axis of ordinates indicating the transfer ratio of the first rotation system 113 is shown in FIG. 7. As shown in FIG. 7, when the contact coefficient increases, the transfer function of the first rotation system 113 is changed in correspondence to it. Further, in this embodiment, the points on the graph of the output value and transfer ratio are plotted, thus a function is obtained, though the function calculating method, if a function expressing the transfer characteristic can be obtained, is not restricted particularly.

Further, the test signal used for controlling the second rotation system 114, similarly to the case of controlling the first rotation system 113, is also added to the control instruction signal to the first drive section 103 and then is used, though the test signal is sent to the first drive section 103 like this, thus the test signal is transferred from the first drive section 103 to the second rotation system 102 via the first rotation body 101 and intermediate transfer belt 115, and the relationship, obtained from it, between the transfer ratio of the second rotation system 114 and the output value of the test signal generating section 109 is examined, thus the transfer function of the second rotation system 114 can be derived. For example, a graph representing the relationship between the control instruction signal to the first drive section 103 and the transfer ratio of the second rotation system 114 when the contact coefficient between the intermediate transfer belt 115 and the second rotation body 102 is changed using the axis of abscissas indicating the frequency of the control instruction signal and the axis of ordinates indicating the transfer ratio of the second rotation system 114 is shown in FIG. 8. As shown in FIG. 8, even if the test signal is added to the control instruction signal to the first drive section 103, when the contact coefficient increases, the transfer function of the second rotation system 114 is changed in correspondence to it.

Here, the first transfer function calculating section 107 and second transfer function calculating section 108 confirm the transfer ratio to the output value, for example, from the 3-Hz test signal generating section 109 and when the value is larger than the value two times of the gain when the signal is not deteriorated, permits the alarming section 112 to notify an alarm. For example, when the gain to 3 Hz when no deterioration is caused is 0.8, if the gain after deteriorated is 1.6 or higher, an alarm is notified. Here, in this embodiment, although 3 Hz greatly affecting the rotation speed of the rotation body is adopted as a reference, if the reference frequency is an input value at a low frequency greatly affecting the rotation speed, another input value may be defined as a reference. Further, in this embodiment, when the measured transfer ratio reaches two times of the transfer ratio when no deterioration occurs, it is controlled hardly, so that the threshold value is set at two times of the gain when no deterioration occurs, though the threshold value, if it is a value which is judged to be not effective in control, is not restricted particularly, and for example, another value can be adopted that the threshold value is defined as an absolute value such that the upper limit of the transfer ratio is set at 2 and the lower limit is set at 0.1.

The first transfer function calculating section 107 and second transfer function calculating section 108 calculate a function identified in a formed graph. The calculating method calculates a function obtained by setting a constitution model of the image output apparatus, expressing the dynamic characteristic including drum driving and belt motion by an equation of motion, and changing the parameters such as the torque constant of the motor varying greatly with the apparatus state and the contact coefficient between the drum and the belt so as to make the characteristic calculated from the equation of motion coincide with the arrangement of the points really plotted on the graph.

The first transfer function calculating section 107 and second transfer function calculating section 108 calculate an inverse function of the obtained function. A method for obtaining the inverse function is to prepare an inverse function for the equation of motion of the dynamic characteristic and replace the formula with a discrete formula in accordance with control sampling.

The first transfer function calculating section 107 and second transfer function calculating section 108 subtract the values of parameters for correcting the respective inverse filters of the repeat control section 151 and repeat control section 161 from the obtained function. Here, in the drive system of the present invention, an article considered to affect variations in the angular velocity of rotation of the rotation body is the torque constant of the drive section, so that the parameters are the torque constant and the contact coefficient between the drum and the belt in the function. Furthermore, the first transfer function calculating section 107 sends the subtracted values of parameters to the first control section 105 and the second transfer function calculating section 108 sends the subtracted values of parameters to the second control section 106.

Here, an example of the second rotation system 114 composing the inverse filter will be explained using the values. Assuming the target angular velocity of rotation of the second rotation body 102 as $\omega_0$ (1001 shown in FIG. 5), a control instruction signal of the inverse filter before calibration to obtain the angular velocity as $X_0$ (1002 shown in FIG. 5), and the transfer function of the second rotation system 114 before variation as $F_0(X)$, $\omega_0=F_0(X_0)$ (1003 shown in FIG. 5) is held originally. In other words, assuming the inverse function of $Y=F_0(X)$ as $X=F_0^{-1}(Y)$ (1004 shown in FIG. 5), $X_0=F_0^{-1}(\omega_0)$ is held. However, depending on adhesion of toner and the magnitude of the contact coefficient between the second rotation body 102 and the intermediate transfer belt 115, the transfer characteristic of the second rotation system 114 is changed. Therefore, the second transfer function calculating section 108 calculates the changed transfer function from the output value (the test signal sent to the first drive section 103) from the test signal generating section 109 and the angular velocity of rotation detected by the second rotation speed detecting section 111 and the transfer function is assumed as $Y=F(X)$. In the case of $Y=F(X)$, even if a control instruction signal $X_0$ is inputted, the target angular velocity of rotation of the second rotation body 102 cannot be obtained. Therefore, the second transfer function calculating section 108 obtains an inverse function $X=F^{-1}(Y)$ (1005 shown in FIG. 5) of the obtained transfer function. The second transfer function calculating section 108 sends the parameters of the torque constant of $F^{-1}(Y)$ and the contact coefficient between the second rotation body 102 and the intermediate transfer belt 115 to the repeat control section 161 and the repeat control section 161 changes the function of the inverse filter to $F^{-1}(Y)$ (1006 shown in FIG. 5). Here, the repeat control section 161, upon receipt of the target value $\omega_0$ of the angular velocity of rotation of the second rotation body 102, obtains a control instruction signal $F^{-1}(\omega_0)$ (1007 shown in FIG. 5). The control instruction signal $F^{-1}(\omega_0)$ is $\omega_0=F(F^{-1}(\omega_0))$ (1008 shown in FIG. 5), so that it is an input value that when passing the current transfer function $F(X)$ of the second rotation system 114, it becomes $\omega_0$. As mentioned above, the repeat control section 161 obtains a control instruction signal for obtaining the target value of the angular velocity of rotation of the second rotation body 102 after the transfer characteristic is changed and sends the control instruction signal to the second drive section 104.

In other words, it may be said that the second transfer function calculating section 108 measures that the transfer function of the second rotation system 114 is changed from $F_0(X)$ to $F(X)$ and calibrates the inverse filter of the repeat control section 161 using the inverse function $F^{-1}(Y)$ thereof.

The operation of the first rotation system 113 is the same as that of the second rotation system 114.

The aforementioned calibration of the inverse filter due to parameter change, in this embodiment, is executed by performing the calibration operation at the time decided by an operator such as once a day or once a month and the calibration for the calibrated inverse filter is structured so as to be kept in the present state until the next calibration operation is performed. For example, the original image forming mode and calibration mode are installed in the image forming apparatus, and in the calibration mode, as explained above, the inverse filter of the repeat control section 161 is calibrated from $F_0^{-1}(Y)$ to $F^{-1}(Y)$, and the same operation is simultaneously performed for the repeat control section 151, and after the calibration is finished, the mode is switched to the image forming mode, and the connection for adding the test signal from the test signal generating section 109 to the control instruction signal, the connection from the first transfer function calculating section 107 to the repeat control section 151, and the connection from the second transfer function calculating section 108 to the repeat control section 161 are cut off, thus the original image formation is performed. In the image forming mode, a constitution may be used that the first transfer function calculating section 107, upon receipt of the output value from the test signal generating section 109 and the angular velocity of rotation from the first rotation speed detecting section 110, when the output value is larger than the threshold value aforementioned, permits the alarming section 112 to notify an alarm and similarly, the second transfer function calculating section 108, upon receipt of the output value from the test signal generating section 109 and the angular velocity of rotation from the second rotation speed detecting section 111, when the output value is larger than the threshold value aforementioned, permits the alarming section 112 to notify an alarm. Such timing for performing the calibration mode is decided according to the degree of deterioration of the first rotation system 113 and second rotation system 114 for the time.

Next, by referring to FIG. 4, the flow of calibration of the inverse filter by the second transfer function calculating section 108 will be explained. Here, FIG. 4 is a drawing showing the flow of calibration of the inverse filter by the second transfer function calculating section 108.

Step S001: The test signal generating section 109 sends the test signal to the second transfer function calculating section 108 and puts the test signal on the control instruction signal sent from the first control section 105 to the first drive section 103.

Step S002: The second rotation speed detecting section 111 detects the angular velocity of rotation of the second rotation body 102 and sends it to the second transfer function calculating section 108.

Step S003: The second transfer function calculating section 108 calculates the transfer ratio corresponding to the output value of the test signal generating section 109 on the basis of the received angular velocity of rotation and stores it in the memory section.

Step S004: The second transfer function calculating section 108 judges whether the predetermined number of times (5000 times) is completed or not. When it is not completed, the second transfer function calculating section 108 repeats Steps S001 to S003 and when it is completed, goes to Step S005.

Step S005: The second transfer function calculating section 108 plots the stored 5000 output values of the test signal generating section 109 and the transfer ratios corresponding to the output values of the test signal generating section 109, thereby forms a graph.

Step S006: The second transfer function calculating section 108 judges whether the transfer ratio at the prescribed frequency (3 Hz) exceeds the threshold value (1.6) or not. When it does not exceed the threshold value, the second transfer function calculating section 108 goes to Step S007 and when it exceeds the threshold value, the second transfer function calculating section 108 goes to Step S011.

Step S007: The second transfer function calculating section 108 forms a function ($Y=F(X)$) representing the transfer characteristic.

Step S008: The second transfer function calculating section 108 forms an inverse function ($X=F^{-1}(Y)$) of the function $Y=F(X)$.

Step S009: The second transfer function calculating section 108 subtracts the parameter value from the inverse function $X=F^{-1}(Y)$ and sends the concerned parameter value to the second control section 106.

Step S010: The second control section 106 receives the parameter value from the second transfer function calculating section 108 and calibrates the inverse filter held by the repeat control section 161.

Step S011: The second transfer function calculating section 108 permits the alarming section 112 to notify an alarm and finishes the correction of the inverse filter.

The flow of calibration of the inverse filter by the second transfer function calculating section 108 is explained above as an example, though the calibration of the inverse filter by the first transfer function calculating section 107 is executed in the same flow.

Fourth Embodiment

The fourth embodiment of the present invention will be explained. The fourth embodiment of the present invention, as a test signal, instead of a white noise including from a low frequency band to a high frequency band, uses a test signal in a low frequency band and calibrates the inverse filter.

In this respect, when many noises are added to the control instruction signal, a fear of an occurrence of a displacement of an image to be formed is increased. Therefore, when the frequency band of the test signal is narrowed as much as possible, the effect on image formation is reduced. Furthermore, the frequency band affecting most the angular velocities of rotation of the first rotation body 101 and second rotation body 102 is a frequency band having a cycle close to the time required for one rotation of the first rotation body 101 and second rotation body 102 and since both first rotation body 101 and second rotation body 102 rotate two or three times for one second, it is desirable to use a test signal in a low frequency band, particularly a test signal in a frequency band of 2 or 3 Hz. As mentioned above, only by a signal in a frequency band for affecting most the angular velocities of rotation of the first rotation body 101 and second rotation body 102, the effect on the angular velocities of rotation of the first rotation body 101 and second rotation body 102 is great and the effect by a signal in another frequency band is negligibly small compared with it, so that the input value can be controlled.

Here, the operation of the image forming apparatus in this embodiment will be explained. Upon receipt of a signal obtained by adding a signal in a low frequency band from the test signal generating section 109 to the control instruction signal outputted by the first the control section 105, the first rotation body 101, second rotation body 102, first drive section 103, second drive section 104, first rotation speed detecting section 110, and second rotation speed detecting section 111 operate similarly to the third embodiment and the angular velocity of rotation is sent to both first transfer function calculating section 107 and second transfer function calculating section 108. Further, the output value having a low frequency component from the test signal generating section 109 is sent to both first transfer function calculating section 107 and second transfer function calculating section 108.

The first transfer function calculating section 107 and second transfer function calculating section 108, upon receipt of the angular velocity of rotation and the output value from the test signal generating section 109, similarly to the first embodiment, obtains the respective transfer ratios of the first rotation system 113 and second rotation system 114 corresponding to the output value having a low frequency component from the test signal generating section 109. The first transfer function calculating section 107 and second transfer function calculating section 108, similarly to the first embodiment, store the respective output values obtained from the test signal generating section 109 and the transfer ratios corresponding to them in memory sections (not drawn) installed in the first transfer function calculating section 107 and second transfer function calculating section 108, put the output values from the test signal generating section 109 on the axis of abscissas, put the transfer ratios of the first rotation system 113 and second rotation system 114 on the axis of ordinates, plot the stored points, form graphs representing the respective transfer characteristics of the first rotation system 113 and second rotation system 114, obtain the transfer functions which are functions identified in the graphs, calculate inverse functions of the transfer functions, thereby calculate parameters for calibrating the inverse filter, and send the parameters to the first control section 105 and second control section 106.

The first control section 105 and second control section 106, similarly to the first embodiment, calibrate the inverse filter using the received parameters, calculate control instruction signals corresponding to the target rotation speeds of the first rotation body 101 and second rotation body 102, and send the control instruction signals to the first drive section 103 and second drive section 104.

As mentioned above, the first control section 105 and second control section 106 control the first rotation body 101 and second rotation body 102 using a signal having a low frequency component affecting greatly the rotation speeds of the first rotation body 101 and second rotation body 102 as a test signal, thereby by lightening the load due to operations by the first transfer function calculating section 107 and second transfer function calculating section 108, can control accurately the first rotation body 101 and second rotation body 102.

Fifth Embodiment

The fifth embodiment of the present invention will be explained. The fifth embodiment of the present invention is a color image forming apparatus and is structured so as to include, as a second rotation body 102, four photosensitive drums of cyan, magenta, yellow, and black. And, using a test signal at a frequency having a cycle integer-times of the time required for the intermediate transfer belt 115 to move at the distance between the neighboring transfer positions of the photosensitive drums to the intermediate transfer belt 115, the inverse filter is calibrated.

In this respect, the test signal is a noise to the last and when the test signal is added to the control instruction signal, there is a fear that a displacement of an image to be formed may occur. In this respect, when a test signal at a frequency having a cycle integer-times of the time (hereinafter, referred to as an "inter-drum pitch") required for the intermediate transfer belt 115 to move at the distance between the neighboring transfer positions of the photosensitive drums to the intermediate transfer belt 115 is used, the input value of the test signal at time of transfer can be defined as 0 and the effect on the image displacement can be reduced.

Here, the operation of the image forming apparatus in this embodiment, except that the signal outputted from the test signal generating section 109 as a test signal is a test signal at a frequency having a cycle integer-times of the pitch between the drums, is the same as that of the third embodiment.

Furthermore, the torque constant and the contact coefficient between the photosensitive drum which is the second rotation body 102 and the intermediate transfer belt 115 are changed beforehand, and the transfer characteristics of the first rotation system 113 and second rotation system 114 under various conditions are measured and stored, thus by the first transfer function calculating section 107 and second transfer function calculating section 108, the degree of transfer of a test signal at a frequency having a cycle integer-times of the pitch between the drums and the transfer characteristic measured beforehand are compared, thus the conditions of the first rotation system 113 and second rotation system 114 can be inferred, and using the transfer function in accordance with the conditions, the repeat control section 151 and repeat control section 161 can be calibrated. By doing this, by forming an image, the control conditions for the repeat control section 151 and repeat control section 161 can be optimized.

According to the image forming apparatus of this embodiment, the transfer function is obtained by using a test signal including from a low frequency to a high frequency from the outside of the rotation body, so that a transfer function in a wide frequency band can be obtained. Therefore, by the transfer function obtained by using the transfer characteristic of a low frequency component for affecting strongly the rotation of the rotation body, parameters for changing the inverse filter for controlling the repetitive variation component of the rotation body can be calculated. Namely, more appropriate parameter values for changing the inverse filter for controlling the repetitive variation component of the rotation body can be calculated, so that the rotation body can be controlled precisely and accurate image formation can be realized.

According to the image forming apparatus of this embodiment, using the transfer function in a wide frequency band including from a low frequency to a high frequency, parameter values for changing the inverse filter can be obtained, thus by controlling the repetitive variation component of the rotation body and executing the feedback control, fine variations of the rotation body different in the frequency and sudden variations can be controlled. By doing this, the rotation body can be controlled more precisely and accurate image formation can be realized.

According to the image forming apparatus of this embodiment, the transfer function is obtained by using a test signal including from a low frequency to a high frequency from the outside of the first rotation body and the second rotation body, so that a transfer function in a wide frequency band for each rotation body can be obtained. Therefore, by the transfer function obtained by using the transfer characteristic of a low frequency component for affecting strongly the rotation of the rotation body, parameters for changing the inverse filter for controlling the repetitive variation component of the rotation body can be calculated. Namely, more appropriate parameter values for changing the inverse filter for controlling the repetitive variation component of each of the rotation bodies can be calculated, so that each of the rotation bodies can be controlled precisely and accurate image formation can be realized.

What is claimed is:

1. An image forming apparatus comprising:

a rotation body which is used for transferring an image, a drive section which rotates the rotation body, a control section which sends a control signal to the drive section to control a speed of the rotation body, a test signal generating section which generates a test signal and adds the test signal to the control signal;

an angular velocity detecting section which detects an angular velocity of rotation of the rotation body; and a transfer function calculating section which obtains a latest transfer function of a rotation system including the rotation body and the drive section, based on the angular velocity of rotation detected by the angular velocity detecting section, and the test signal generated by the test signal generating section, wherein the control section controls the drive section, based on the latest transfer function obtained by the transfer function calculating section wherein the control section comprises a repeat control section, which is previously provided with an inverse filter, the inverse filter being based on an inverse function of the transfer function, and outputs the control signal obtained by making information of a specified target angular velocity pass through the inverse filter, wherein the transfer function calculating section sends to the repeat control section a parameter value for changing, based on the latest transfer function, the inverse filter into an inverse filter for the latest transfer function.

2. The image forming apparatus of claim 1, further comprising a PI control section which performs a proportional control and an integral control based on the angular velocity of rotation, in addition to the control of the drive section based on the control signal of the repeat control section.

3. The image forming apparatus of claim 1, further comprising an alarming section which notifies an alarm in cases where a value of the transfer function exceeds a prescribed value.

4. The image forming apparatus of claim 1, wherein the rotation body comprises a photosensitive drum.

5. The image forming apparatus of claim 1, wherein the rotation body comprises an intermediate transfer belt.

6. The image forming apparatus of claim 1, wherein the test signal has a frequency component within a prescribed region.

7. An image forming apparatus comprising:

a first rotation body which rotates an image carrier for transferring an image to a transfer sheet;

a second rotation body for transferring an image to the image carrier;

a first drive section which rotates the first rotation body, and a second drive section which rotates the second rotation body;

a first control section which sends a control signal to the first drive section and controls a speed of the first rotation body;

a second control section which sends a control signal to the second drive section and controls a speed of the second rotation body;

a test signal generating section which generates a test signal and adds the test signal to the control signal of the first drive section;

a second angular velocity detecting section which detects an angular velocity of rotation of the second rotation body; and a second transfer function calculating section which obtains a latest transfer function of a second rotation system including the second rotation body and the second drive section, based on the angular velocity of rotation detected by the second angular velocity detecting section and the test signal generated by the test signal generating section, wherein the second control section controls the second drive section, based on the latest transfer function obtained by the second transfer function calculating section, wherein the second control section comprises a repeat control section, which is previously provided with an inverse filter, the inverse filter being based on an inverse function obtained by the second transfer function, and outputs the control signal obtained by making information of a specified target rotation speed of the second rotation body pass through the inverse filter, and wherein the second transfer function calculating section sends to the repeat control section a parameter value for changing, based on a latest transfer function obtained by the second transfer function calculating section, the inverse filter into an inverse filter for the latest transfer function.

8. The image forming apparatus of claim 7, further comprising a PI control section which performs a proportional control and integral control based on the angular velocity of rotation of the second rotation body, in addition to the control of the second drive section based on the control signal of the repeat control section in the second control section.

9. The image forming apparatus of claim 7, further comprising an alarming section, which notifies an alarm in cases where a value of the first transfer function or the second transfer function exceeds a prescribed value.

10. The image forming apparatus of claim 7, wherein the test signal is a signal that has a frequency component within a prescribed region.

11. The image forming apparatus of claim 7, wherein the image carrier comprises an intermediate transfer belt, and the second rotation body comprises a plurality of photosensitive drums, wherein the test signal has a frequency corresponding to a period of integral multiplication of a time period which is needed for the intermediate transfer belt to move between two adjoining transfer positions, each of the transfer positions being where an image is transferred to the intermediate transfer belt from each of the plurality of photosensitive drums.

12. An image forming apparatus comprising:

a first rotation body which rotates an image carrier for transferring an image to a transfer sheet;

a second rotation body for transferring an image to the image carrier;

a first drive section which rotates the first rotation body, and a second drive section which rotates the second rotation body;

a first control section which sends a control signal to the first drive section and controls a speed of the first rotation body;

a second control section which sends a control signal to the second drive section and controls a speed of the second rotation body;

a test signal generating section which generates a test signal and adds the test signal to the control signal of the first drive section;

a first angular velocity detecting section which detects an angular velocity of rotation of the first rotation body; and a first transfer function calculating section which obtains a latest transfer function of a first rotation system including the first rotation body and the first drive section, based on the angular velocity of rotation detected by the first angular velocity detecting section and the test signal generated by the test signal generating section;

wherein the first control section controls the first drive section, based on the latest transfer function obtained by the first transfer function calculating section, a second angular velocity detecting section which detects an angular velocity of rotation of the second rotation body; and a second transfer function calculating section which obtains a latest transfer function of a second rotation system including the second rotation body and the second drive section, based on the angular velocity of rotation detected by the second angular velocity detecting section and the test signal generated by the test signal generating section;

wherein the second control section controls the second drive section, based on the latest transfer function obtained by the second transfer function calculating section, wherein the first control section comprises a repeat control section, which is previously provided with an inverse filter, the inverse filter being based on an inverse function obtained by the first transfer function, and outputs the control signal obtained by making information of a specified target rotation speed of the first rotation body pass through the inverse filter, and wherein the first transfer function calculating section sends to the repeat control section a parameter value for changing, based on a latest transfer function obtained by the first transfer function calculating section, the inverse filter into an inverse filter for the latest transfer function.

13. The image forming apparatus of claim 12, further comprising a PI control section which performs a proportional control and integral control based on the angular velocity of rotation of the first rotation body, in addition to the control of the first drive section based on the control signal of the repeat control section in the first control section.

14. The image forming apparatus of claim 12, further comprising an alarming section, which notifies an alarm in cases where a value of the first transfer function or the second transfer function exceeds a prescribed value.

15. The image forming apparatus of claim 12, wherein the image carrier comprises an intermediate transfer belt, and the second rotation body comprises a plurality of photosensitive drums, wherein the test signal has a frequency corresponding to a period of integral multiplication of a time period which is needed for the intermediate transfer belt to move between two adjoining transfer positions, each of the transfer positions being where an image is transferred to the intermediate transfer belt from each of the plurality of photosensitive drums.

* * * * *